US009717317B2

(12) United States Patent
Kim et al.

(10) Patent No.: US 9,717,317 B2
(45) Date of Patent: Aug. 1, 2017

(54) CAPSULE COSMETICS AND MANUFACTURING METHOD THEREOF

(71) Applicants: CTK CO., LTD, Seongnam-si (KR); Jin Woo Kim, Gwangmyeong-si (KR)

(72) Inventors: Jin Woo Kim, Gwangmyeong-si (KR); In Yong Chung, Seoul (KR)

(73) Assignee: CTK CO., LTD, Seoul (KR)

( * ) Notice: Subject to any disclaimer, the term of this patent is extended or adjusted under 35 U.S.C. 154(b) by 0 days.

(21) Appl. No.: 14/361,257

(22) PCT Filed: Apr. 25, 2014

(86) PCT No.: PCT/KR2014/003684
§ 371 (c)(1),
(2) Date: May 28, 2014

(87) PCT Pub. No.: WO2015/046698
PCT Pub. Date: Apr. 2, 2015

(65) Prior Publication Data

US 2016/0206078 A1 Jul. 21, 2016

(30) Foreign Application Priority Data

Sep. 24, 2013 (KR) ..... 10-2013-0113421

(51) Int. Cl.
*B65D 88/18* (2006.01)
*A45D 34/00* (2006.01)
(Continued)

(52) U.S. Cl.
CPC ..... *A45D 34/00* (2013.01); *A45D 37/00* (2013.01); *B65B 3/12* (2013.01);
(Continued)

(58) Field of Classification Search
CPC .... B65B 3/04; B65B 3/10; B65B 3/12; B65D 88/18; B65D 21/086
(Continued)

(56) References Cited

U.S. PATENT DOCUMENTS 3,860,348 A * 1/1975 Doyle ..... A47L 25/08 401/132
5,865,194 A * 2/1999 Gueret ..... A45D 33/02 132/299
2003/0086742 A1* 5/2003 Gueret ..... A45D 34/04 401/130

FOREIGN PATENT DOCUMENTS

JP 2004-313791 A 11/2004
KR 20-0350255 Y1 5/2004
(Continued)

*Primary Examiner* — Jennifer C Chiang
*Assistant Examiner* — Joshua Wiljanen
(74) *Attorney, Agent, or Firm* — John K. Park; Park Law Firm

(57) ABSTRACT

Disclosed herein are capsule cosmetics and a manufacturing method thereof. This invention uses a one-piece type capsule container. After a liquid cosmetic material and a porous impregnation member are put into the container to manufacture cosmetics, the container is sealed by a sealing member, so that the porous impregnation member is naturally impregnated with the liquid cosmetic material. This allows the loading or impregnation of the liquid cosmetic material to be rapidly, easily, and simply realized, thus reducing manufacturing cost of the capsule cosmetics. As a result, this invention can afford inexpensive and high-quality products to consumers.

5 Claims, 5 Drawing Sheets

(51) Int. Cl.
*A45D 37/00* (2006.01)
*B65B 3/12* (2006.01)

(52) U.S. Cl.
CPC ..... *A45D 2200/1018* (2013.01); *A45D 2200/1036* (2013.01); *B65D 88/18* (2013.01)

(58) Field of Classification Search
USPC ..... 401/132, 133, 135, 196, 202, 207, 261, 401/265; 141/71, 73, 77
See application file for complete search history.

(56) References Cited

FOREIGN PATENT DOCUMENTS

| | | | |
|---|---|---|---|
| KR | 20-0448873 | Y1 | 12/2009 |
| KR | 10-2012-0108509 | A | 10/2012 |
| KR | 10-2013-0083852 | A | 7/2013 |

* cited by examiner

[Fig. 1]
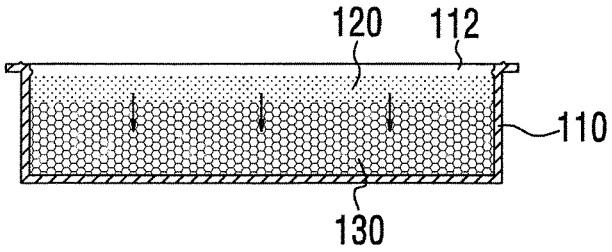
[Fig. 2]
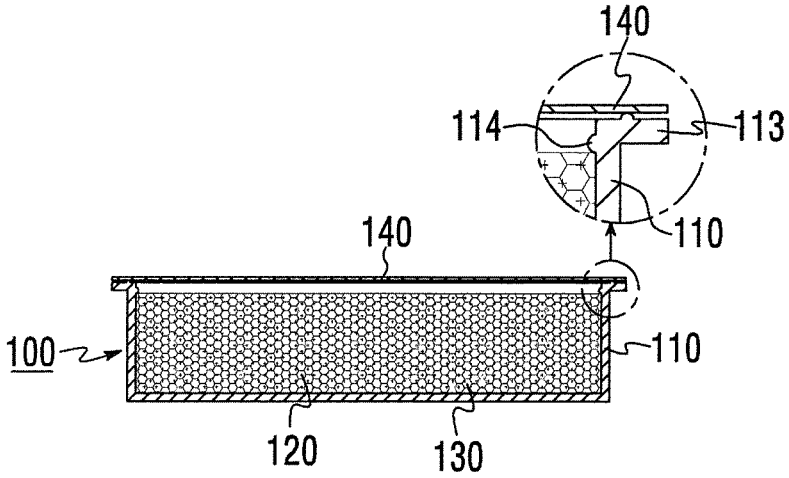
[Fig. 3]
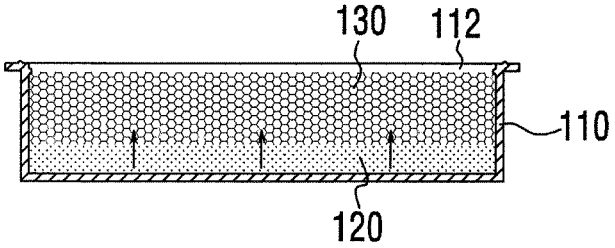
[Fig. 4]
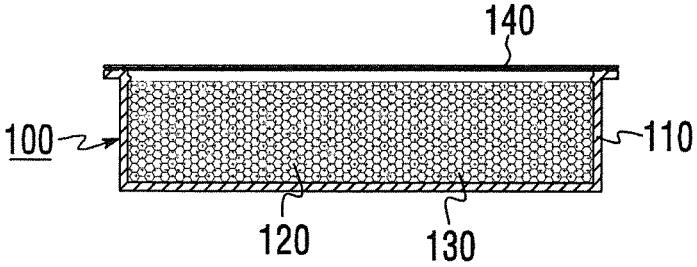
[Fig. 5]
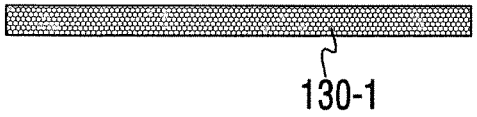

[Fig. 6]
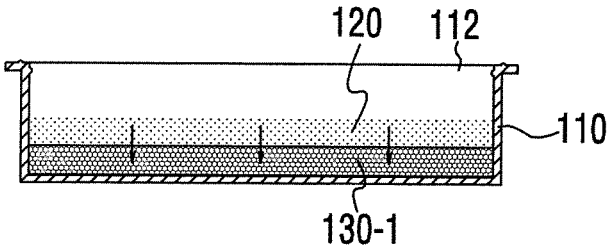
[Fig. 7]
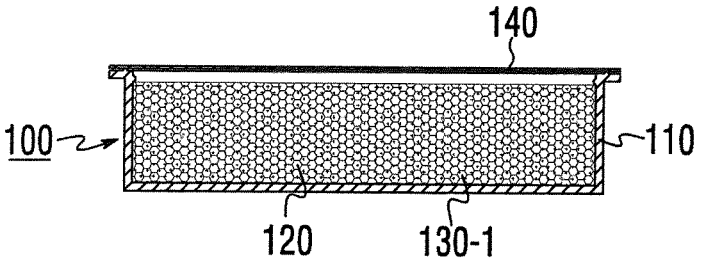
[Fig. 8]
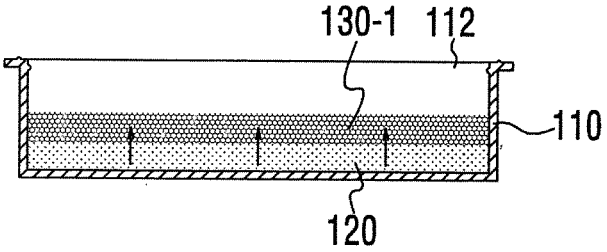
[Fig. 9]
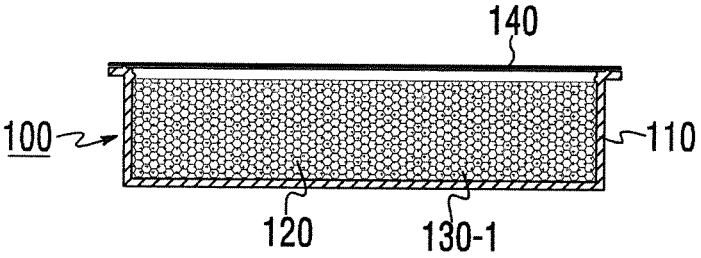

[Fig. 10]
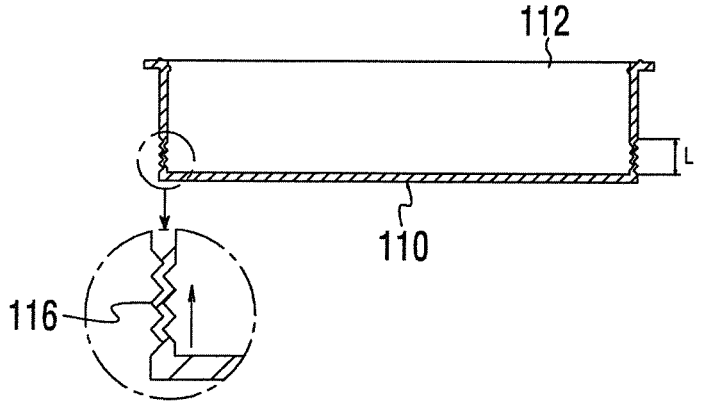
[Fig. 11]
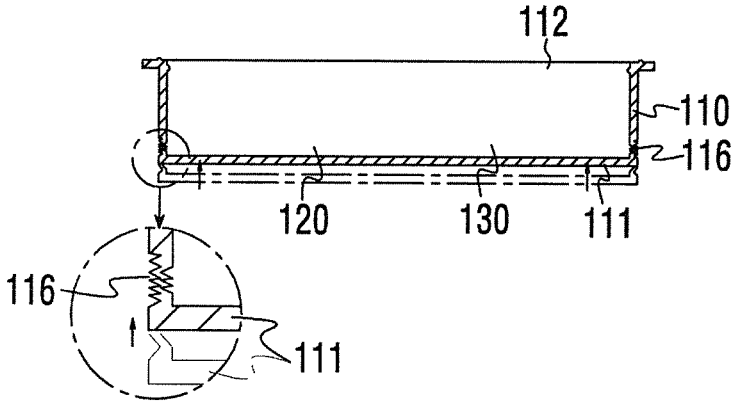
[Fig. 12]
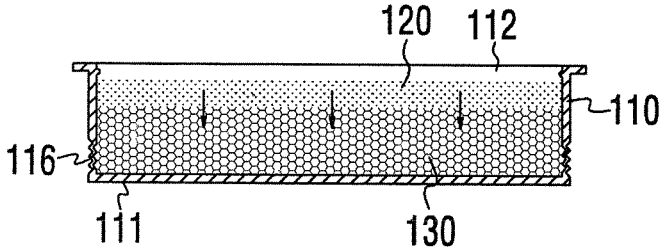
[Fig. 13]
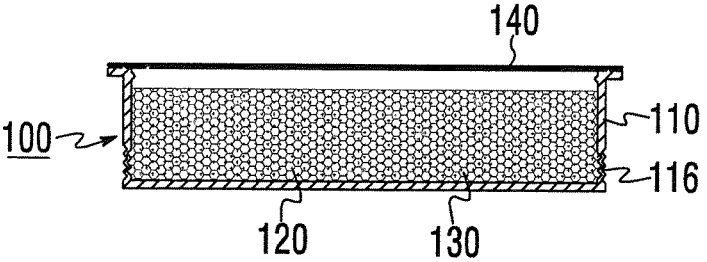

[Fig. 14]
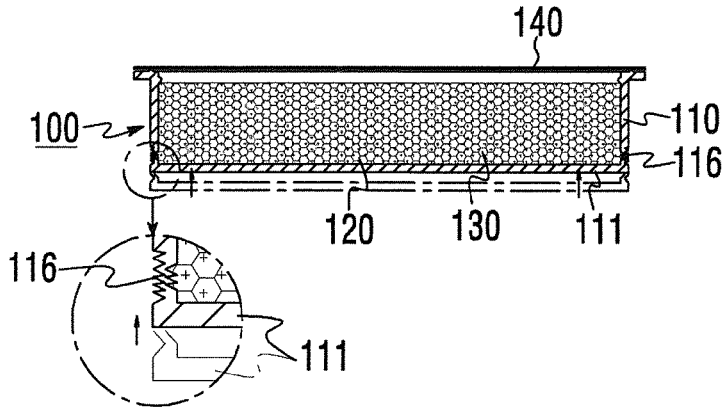
[Fig. 15]
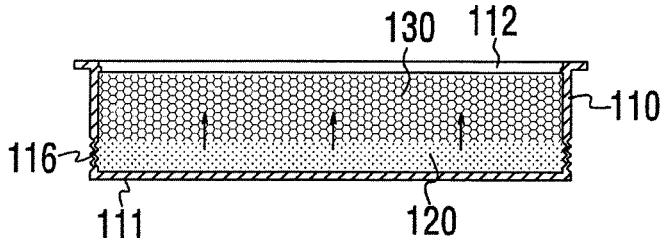
[Fig. 16]
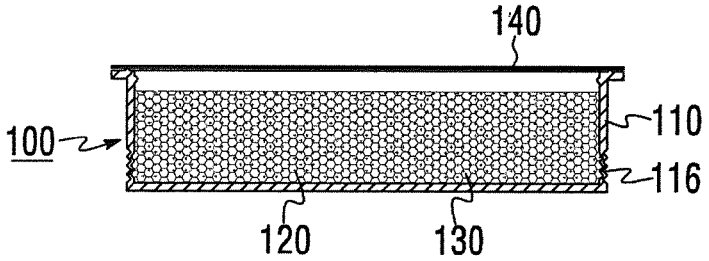
[Fig. 17]
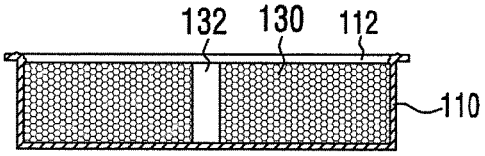
[Fig. 18]
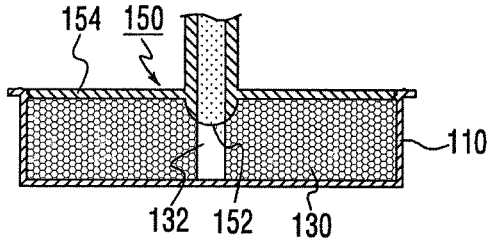

[Fig. 19]
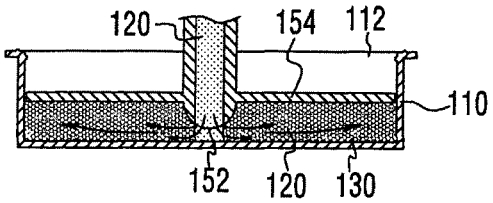
[Fig. 20]
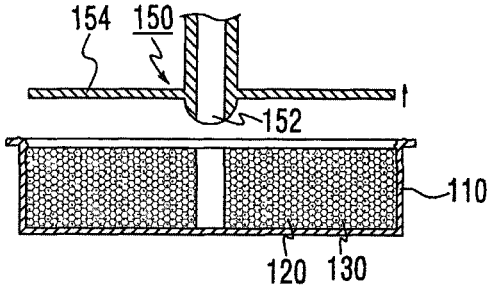
[Fig. 21]
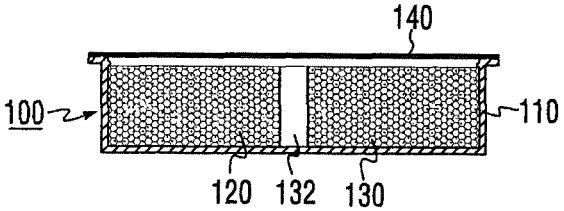

CAPSULE COSMETICS AND MANUFACTURING METHOD THEREOF

TECHNICAL FIELD

The present invention relates to capsule cosmetics, in which an impregnation member is impregnated with a liquid cosmetic material using a one-piece type capsule container, and a manufacturing method thereof.

BACKGROUND ART

Conventionally, a liquid cosmetic material is loaded into various kinds of cosmetic containers to be distributed and stored, but it is very inconvenient to carry the containers. In order to solve the problem of inconvenience, recently, various methods are considered to allow the liquid cosmetic material to be more conveniently carried. As an example of the methods, a compact type container has been proposed. Further, a method of loading the liquid cosmetic material in a carrier is considered.

However, the liquid cosmetic material applied to the conventional compact type container is loaded into the carrier and then held in a refill container or cosmetic container to be used, this container being in a multi-structure which has at least two pieces, for instance, a container body and a covering such as a folding lid to prevent the removal of the carrier filled with the liquid cosmetic material. Further, the liquid cosmetic material manufactured to be loaded into the container is currently utilized.

Thus, the conventional liquid cosmetic material is held or loaded in a refill container having at least two pieces to be used (refer to FIG. 3 of patent document 1), so that manufacturing cost is naturally increased due to the manufacture of the container having the two or more pieces, and besides, the liquid cosmetic material is previously loaded into the carrier and then put into the refill container to be used, so that the assembly and filling require an excessively long time.

DOCUMENTS OF RELATED ART (Patent Document 1) Korean Patent Laid-Open Publication No. 10-2012-0108509 (published on Oct. 5, 2012)

DISCLOSURE OF INVENTION

Technical Problem

Accordingly, the present invention has been made keeping in mind the above problems occurring in the related art, and is intended to provide capsule cosmetics and a manufacturing method thereof, in which a liquid cosmetic material and a porous impregnation member are put into a one-piece type capsule container to be sealed, thus making it very convenient, rapid and easy to fill and impregnate the porous impregnation member with the liquid cosmetic material.

Solution to Problem

In an aspect, the present invention provides capsule cosmetics, including a one-piece type capsule container having on a side thereof an opening; a liquid cosmetic material and a porous impregnation member configured to be loaded into and received in the capsule container to manufacture the cosmetics; and a sealing member configured to seal and block the opening of the capsule container.

The liquid cosmetic material and the impregnation member, which are put into the capsule container, may be configured such that the porous impregnation member is first received in a bottom the capsule container and then the liquid cosmetic material is loaded thereon to impregnate the porous impregnation member with the liquid cosmetic material, or such that the liquid cosmetic material is first loaded and then the impregnation member is received thereon to impregnate the porous impregnation member with the liquid cosmetic material.

The porous impregnation member put into the capsule container may include a compressive-type porous impregnation member which is compressed to be gradually swollen during the filling of the liquid cosmetic material.

The capsule container may further include a flexible portion to perform expansion and contraction when an external force is applied thereto.

The flexible portion may have a form of a bellows.

In another aspect, the present invention provides capsule cosmetics including a one-piece type capsule container having on a side thereof an opening; a porous impregnation member configured to be put into the capsule container to manufacture the cosmetics, with a filling hole formed in the porous impregnation member; and a sealing member configured to seal and block the opening of the capsule container, wherein the porous impregnation member is pressurized using a filling member having a nozzle fitted into the filling hole and a pressing plate, thus forcibly loading the liquid cosmetic material, and a pressurizing force is released from the porous impregnation member such that the porous impregnation member returns to an original state thereof from a compressed state, thus enabling rapid absorption and impregnation of the liquid cosmetic material.

In a further aspect, the present invention provides a method of manufacturing capsule cosmetics including loading a liquid cosmetic material into a one-piece type capsule container having on a side thereof an opening to manufacture the cosmetics; putting a porous impregnation member into the capsule container; and sealing the opening of the capsule container by a sealing member, whereby the porous impregnation member is impregnated with the liquid cosmetic material.

The porous impregnation member may be first received in a bottom of the capsule container and then the liquid cosmetic material may be loaded thereon to impregnate the porous impregnation member while the liquid cosmetic material is infiltrated from an upper portion to a lower portion of the porous impregnation member, or the liquid cosmetic material may be first loaded and then the impregnation member may be placed thereon such that the liquid cosmetic material is infiltrated from the lower portion to the upper portion of the porous impregnation member.

The porous impregnation member may use a compressive-type porous impregnation member, so that the porous impregnation member is impregnated with the liquid cosmetic material while being gradually swollen during the loading of the liquid cosmetic material.

The capsule container may further include a flexible portion to perform expansion and contraction, so that, as the flexible portion is contracted by an external force, the porous impregnation member which has been put into the capsule container and primarily impregnated with the liquid cosmetic material is again impregnated with the liquid cosmetic material and is compressed.

In yet another aspect, the present invention provides a method of manufacturing capsule cosmetics including putting a porous impregnation member into a one-piece type capsule container having on a side thereof an opening, with a filling hole formed in the porous impregnation member; inserting a nozzle of a filling mechanism into the filling hole; and forcibly loading a liquid cosmetic material while the porous impregnation member is pressurized using a pressing plate, and simultaneously releasing a pressurizing force of the filling mechanism from the porous impregnation member, thus returning the porous impregnation member to an original state thereof from a pressed state, and thereby enabling rapid absorption and impregnation of the liquid cosmetic material.

Advantageous Effects of Invention

According to the present invention, capsule cosmetics are manufactured by putting or loading a liquid cosmetic material and a porous impregnation member into a one-piece type capsule container and then sealing the container, so that it is very convenient and rapid to load the liquid cosmetic material, and the porous impregnation member is continuously impregnated with the liquid cosmetic material even after the sealing, so that the impregnation efficiency of the liquid cosmetic material is significantly increased and the time of manufacturing the capsule cosmetics is significantly shortened, and manufacturing cost is minimized, thus being very economical.

Further, the present invention is advantageous in that cosmetics are manufactured using a one-piece type capsule container, so that the capsule cosmetics can be very simply manufactured in various sizes.

Furthermore, the present invention is advantageous in that a porous impregnation member put into a capsule container is configured to be filled and impregnated with a liquid cosmetic material using a filling mechanism, thus making it possible to more rapidly fill and impregnate the porous impregnation member with the liquid cosmetic material.

BRIEF DESCRIPTION OF DRAWINGS

FIGS. 1 and 2 are sectional views showing the state before and after the impregnation of capsule cosmetics according to a first embodiment of the present invention;

FIGS. 3 and 4 are sectional views showing the state before and after the impregnation, in which the arrangement of a liquid cosmetic material and a porous impregnation member is different from that of FIGS. 1 and 2;

FIGS. 5 to 7 are sectional views showing a compressed-type porous impregnation member and the state before and after the impregnation using the impregnation member, in FIGS. 1 and 2;

FIGS. 8 and 9 are sectional views showing the state before and after the impregnation, in which the arrangement of a liquid cosmetic material and the compressed-type porous impregnation member is different from that of FIGS. 5 to 7;

FIGS. 10 and 11 are partial sectional views showing a modification of a capsule container according to the present invention and the state before and after a folding portion is folded;

FIGS. 12 to 14 are sectional views showing the state before and after the impregnation of the liquid cosmetic material, using the capsule container according to the modification of FIGS. 10 and 11;

FIGS. 15 and 16 are sectional views showing the state before and after the impregnation, in which the arrangement of a liquid cosmetic material and the porous impregnation member is different from that of FIGS. 12 to 14; and FIGS. 17 to 21 are sectional views sequentially showing the state before and after the impregnation of capsule cosmetics, according to a second embodiment of the present invention.

MODE FOR THE INVENTION

Hereinbelow, preferred embodiments of the present invention will be described in detail with reference to the accompanying drawings.

In the present invention, capsule cosmetics mean the cosmetics held in a capsule container. In this context, the cosmetics mean a type in which a porous impregnation member is impregnated with a liquid cosmetic material.

According to an embodiment of the present invention, as shown in FIGS. 1 and 2, capsule cosmetics 100 include a one-piece type capsule container 110 having an opening 112 on a side thereof. Further, a liquid cosmetic material 120 and a porous impregnation member 130 are put into the capsule container 110 to manufacture cosmetics. The opening 112 of the capsule container is sealed by a sealing member 140, so that the opening 112 of the capsule container is finally blocked.

Here, the one-piece type capsule container 100 means that it has no separate foldable lid or covering for the container as in the related art, and it is possible to manufacture the capsule cosmetics 100 merely with one capsule container 110.

Generally, such a capsule container 110 may be made through various methods, such as an injection molding method or a blow molding method, depending on a material. When the capsule container 110 is manufactured through the injection molding method or the blow molding method, synthetic resin is generally used, and a plastic material having properties suitable for the cosmetic container is more preferably used.

Of course, the one-piece type capsule container 110 may be made of a metal material, and more preferably manufactured through a press method using aluminum or zinc alloy.

Meanwhile, the capsule container 110 according to the present invention may formed such that a flange 113 is further enlarged to an outer circumference of the opening 112 as necessary, thus allowing the sealing operation of the sealing member 140 to be more easily performed.

According to the present invention, the porous impregnation member 130 may be made of any material, as long as it is good in impregnating efficiency of the liquid cosmetic material 120. For example, a material having high air permeability, certain elasticity and flexibility is preferable, and a soft material is more preferable. The material having high air permeability and flexibility is good in permeation rate of the liquid cosmetic material, thus allowing the impregnation to be rapidly and superiorly carried out. If the elasticity is good, good elastic restoring force is offered during the use of the cosmetics, thus enhancing use efficiency. As such a material, sponge that is well known to people is an optimum material.

A removal preventing means may be further provided on an inner circumference of the capsule container 110 to prevent the undesirable removal of the porous impregnation member 130 after it is impregnated with the liquid cosmetic material 120. As shown in the enlarged view of FIG. 2, the removal preventing means may have the form of a locking step 114 which is integrally provided on an upper end of an inner circumferential wall. Although not shown in the drawings, the removal preventing means may have the form of a locking step which is provided on an inner circumference of an upper end of the opening 112.

The sealing member 140 configured to seal and block the opening 112 of the capsule container 110 may use a film in the form of an aluminum foil. Such a sealing member performs a sealing function to prevent the leakage of the cosmetics from the capsule container 110, in addition to ensuring air-tightness. This may be a disposable sealing member, so that it is impossible to reuse the sealing member once it is opened. By contrast, if the sealing member is designed to be repeatedly used, the sealing member may be attached to be continuously and repeatedly opened or closed.

The procedure of forming the capsule cosmetics 100 will be described with reference to FIGS. 1 and 2. First, in the state where the opening 112 is open, the liquid cosmetic material 120 and the porous impregnation member 130 are put into the capsule container 110 to manufacture the cosmetics (see FIG. 1). Next, the opening of the capsule container is sealed by the sealing member 140 (see FIG. 2). The liquid cosmetic material held in the capsule container are completely sealed and blocked by the sealing member, so that the leakage of the liquid cosmetic material to the outside is prevented, and simultaneously the liquid cosmetic material infiltrates into the porous impregnation member 130 in a packed state, so that an impregnating operation is carried out.

Thus, in the capsule cosmetics 100 according to an embodiment of the present invention, the porous impregnation member 130 is not impregnated with the liquid cosmetic material through a separate process, but an absorbing/impregnating operation is naturally performed by putting the porous impregnation member 130 into the capsule container 110 and then sealing the capsule container 100 with the sealing member, so that it is convenient and simple to fill and impregnate the porous impregnation member with the liquid cosmetic material.

Meanwhile, in the capsule cosmetics 100 according to an embodiment of the present invention, the liquid cosmetic material 120 and the porous impregnation member 130 may be put into the capsule container 110 as shown in FIG. 1: the porous impregnation member 130 is put into a lower portion of the capsule container 110 and then the liquid cosmetic material 120 is loaded thereon, so that the liquid cosmetic material may be naturally infiltrated into the porous impregnation member 130 and thereby the porous impregnation member 130 may be impregnated with the liquid cosmetic material. By contrast, as shown in FIG. 3, after the liquid cosmetic material 120 is loaded in the lower portion of the capsule container 110, the porous impregnation member 130 may be placed thereon and subsequently final sealing may be performed using the sealing member 140. Through such a configuration, the porous impregnation member 130 can be slowly impregnated with the liquid cosmetic material 120.

Although the methods of arranging the liquid cosmetic material 120 or the porous impregnation member 130 in the capsule container 110 to realize the impregnation are different from each other as described above, there are no significant differences in terms of manufacture. However, considering the impregnating efficiency, the method wherein the porous impregnation member 130 is first put into the capsule container 110 and then the liquid cosmetic material 120 is loaded thereon as shown in FIG. 1 is more preferable.

Meanwhile, in the capsule cosmetics 100 according to an embodiment of the present invention, the porous impregnation member 130 put into the capsule container 110 preferably uses a compressive-type porous impregnation member 130-1 that is prefabricated to be gradually swollen during the filling of the liquid cosmetic material 120, as shown in FIG. 5.

If the compressive-type porous impregnation member 130-1 is put into the capsule container 110 in the compressed state due to the characteristics of its material and then the liquid cosmetic material 120 is loaded, as shown in FIGS. 6 and 7, the liquid cosmetic material are infiltrated into the compressive-type porous impregnation member 130-1, so that the filling space is gradually enlarged to a predetermined volume.

Thus, as shown in FIGS. 6 and 7, before the liquid cosmetic material 120 is loaded, the porous impregnation member 130-1 maintains the compressed state. If the liquid cosmetic material 120 is loaded, the porous impregnation member 130-1 is gradually swollen.

Likewise, the compressive-type porous impregnation member 130-1 may adopt a different arrangement as shown in FIG. 8. That is, even when the liquid cosmetic material 120 is first loaded into the lower portion of the capsule container 110 and then the compressive-type porous impregnation member 130-1 is placed thereon, the liquid cosmetic material may be gradually infiltrated from a lower position to an upper position, thus enlarging the volume. Likewise, the different arrangement of the compressive-type porous impregnation member does not cause changes other than a slight change in impregnation rate. However, it is more preferable that the compressive-type porous impregnation member 130-1 be first put and then the liquid cosmetic material be loaded thereon as shown in FIG. 6, in terms of impregnating efficiency.

In the capsule cosmetics 100 according to an embodiment of the present invention, the capsule container 110 may be further provided with a flexible portion 116 to perform expansion and contraction when external force is applied thereto, as shown in FIG. 10. As long as the flexible portion 116 may perform the expansion and contraction, it is not limited to a specific flexible structure. Most preferably, the flexible portion 116 may be formed in a bellows type to enable easy expansion and contraction in a vertical direction.

When a lower end of the capsule having the flexible portion is subjected to an external force during the use of the capsule cosmetics as shown in FIG. 11, the flexible portion 116 renders a bottom portion 111 of the capsule container 110 to be pushed up within a given distance L. That is, the flexible portion 116 is compressed.

The bottom portion 111 of the capsule container 110 is moved up and thereby the flexible portion 116 is compressed, thus resulting in pushing up the porous impregnation member 130 in the capsule container 110 as shown in FIG. 14. Such an upward pushing action causes the porous impregnation member 130 to be impregnated with the liquid cosmetic material 120 again, thus further enhancing the impregnating efficiency.

The capsule cosmetics 100 using the capsule container 110 having the flexible portion 116 may be likewise configured such that the liquid cosmetic material 120 and the porous impregnation member 130 are arranged in different manners shown in FIG. 12 and FIG. 15. In terms of the impregnating efficiency of the liquid cosmetic material 120, the porous impregnation member 130 is more preferably located in the lower portion of the capsule container 110 as shown in FIG. 12.

The capsule cosmetics 100 according to the present invention may be implemented in a different manner as shown in FIGS. 17 to 21. This embodiment is different from the first embodiment in a configuration of the porous impregnation member 130 that is put into the one-piece type capsule container 110, and in that the liquid cosmetic material is filled using an additional filling mechanism 150 to impregnate the porous impregnation member and then the sealing using the sealing member 140 is performed.

To be more specific, the capsule cosmetics 100 according to the first embodiment is different from the second embodiment in that a filling hole 132 is formed in the porous impregnation member 130 to forcibly fill the liquid cosmetic material 120 as shown in FIG. 17 and a filling operation is performed using a filling mechanism 150 as shown in FIG. 18.

The filling of the liquid cosmetic material for the porous impregnation member 130 is as follows: first, a nozzle 152 of the filling mechanism 150 is aligned with the filling hole 132 formed in the porous impregnation member 130 that is put into the capsule container 110, as shown in FIG. 18, and then the porous impregnation member 130 is pressed under a proper pressure as shown in FIG. 19 using a pressing plate 154 provided above the nozzle 152. In such a compressed state, the liquid cosmetic material 120 is forcibly filled. Then, the liquid cosmetic material is evenly distributed, via the lower edge of the filling hole 132, around the filling hole 132 of the porous impregnation member 130 which is in the compressed state. After the filling of the liquid cosmetic material has been completed, the filling mechanism 150 is removed from the porous impregnation member 130 as shown in FIG. 20 to release a pressurizing force. If the porous impregnation member 130 forcibly returns from the compressed state to an original state, the liquid cosmetic material distributed densely in the compressed state are rapidly absorbed. Such a rapid absorbing operation of the porous impregnation member 130 allows the porous impregnation member 130 to be rapidly impregnated with the liquid cosmetic material (see FIG. 21). After the filling operation of the liquid cosmetic material has been completed, the opening 112 of the capsule container 110 is finally sealed and blocked by the sealing member 140.

In the capsule cosmetics 100 according to the second embodiment configured as described above, the liquid cosmetic material is forcibly filled while the porous impregnation member 130 having the filling hole 132 is pressurized using the filling mechanism 150. Simultaneously, the pressurizing force is released, so that the porous impregnation member 130 is more rapidly impregnated with the liquid cosmetic material filled through the filling mechanism 150.

When a user desires to use the capsule cosmetics according to the present invention, he or she has only to separate the sealing member 140 from the opening 112 of the capsule container 110. The capsule cosmetics themselves may be independently used. If necessary, the capsule cosmetics may be contained in a separate container to be used for the purpose of refilling.

Next, methods of manufacturing capsule cosmetics 100 according to first and second embodiments of the present invention will be described. The methods of manufacturing the capsule cosmetics 100 according to the present invention will be described with reference to FIGS. 1 and 2 to FIGS. 17 to 21.

First, in the method of manufacturing the capsule cosmetics 100 according to the first embodiment of the present invention, preferably, the liquid cosmetic material 120 and the porous impregnation member 130 are put into the one-piece type capsule container 110 having the opening 112 on a side thereof, and the opening 112 of the capsule container 110 is sealed by the sealing member 140, so that the porous impregnation member 130 is impregnated with the liquid cosmetic material.

According to the first embodiment, preferably, the porous impregnation member 130 is first put into the capsule container 110 and the liquid cosmetic material 120 is filled thereon so that the liquid cosmetic material 120 is penetrated from an upper position to a lower position to perform the impregnating operation. Alternatively, the impregnation member 130 and the liquid cosmetic material 120 are preferably put in reverse order, so that the liquid cosmetic material performs the impregnating operation while flowing from a lower position to an upper position of the porous impregnation member 130.

According to the first embodiment, the porous impregnation member 130 preferably uses the compressive-type porous impregnation member, so that the compressive-type porous impregnation member is impregnated with the liquid cosmetic material while being gradually swollen during the loading of the liquid cosmetic material.

Further, according to the first embodiment, the capsule container 110 uses the capsule container which further includes the flexible portion 116. As the flexible portion 16 is compressed by external force, the impregnation and compression of the liquid cosmetic material for the porous impregnation member 130 which has been primarily impregnated with the liquid cosmetic material contained in the capsule container are carried out again.

Preferably, in the method of manufacturing the capsule cosmetics according to the second embodiment of the present invention, only the porous impregnation member 130 with the filling hole 132 is put into the one-piece type capsule container 110 that has on a side thereof the opening 112. Subsequently, the nozzle 152 of the filling mechanism 150 is inserted into the filling hole 132. Afterwards, the liquid cosmetic material 120 is forcibly loaded while the porous impregnation member is pressurized using the pressing plate 154. Simultaneously, the pressing force of the filling mechanism is released from the porous impregnation member 130, so that the porous impregnation member 130 returns from the pressed state to its original state, thus allowing the porous impregnation member 130 to be rapidly impregnated with the liquid cosmetic material.

In comparison with the conventional method of manufacturing a liquid cosmetic material using a cosmetic container or a refill container having two or more pieces, the method according to the present invention allows the loading of the liquid cosmetic material 120 for the porous impregnation member 130 to be rapidly and conveniently performed and considerably reducing a filling time, thus reducing manufacturing cost.

The invention claimed is:

1. Capsule cosmetics, comprising:

a one-piece type capsule container having on a side thereof an opening;

a porous impregnation member configured to be put into the capsule container to manufacture the cosmetics, with a filling hole formed in the porous impregnation member;

a sealing member configured to seal and block the opening of the capsule container; and a filling member having a nozzle fitted into the filling hole and a pressing plate, wherein the porous impregnation member is pressurized using the filling member, thus forcibly loading the liquid cosmetic material, and a pressurizing force is released from the porous impregnation member such that the porous impregnation member returns to an original state thereof from a compressed state, thus enabling rapid absorption and impregnation of the liquid cosmetic material.

2. A method of manufacturing capsule cosmetics, comprising:

loading a liquid cosmetic material into a one-piece type capsule container having on a side thereof an opening to manufacture the cosmetics;

putting a porous impregnation member into the capsule container; and sealing the opening of the capsule container by a sealing member and impregnating the porous impregnation member with the liquid cosmetic material, wherein the capsule container further comprises a flexible portion to perform expansion and contraction, so that, as the flexible portion is contracted by an external force and then released, the porous impregnation member which has been put into the capsule container and primarily impregnated with the liquid cosmetic material is again impregnated with the liquid cosmetic material.

3. The method according to claim 2, wherein the porous impregnation member is first received in a bottom of a lower portion of the capsule container and then the liquid cosmetic material is loaded thereon to impregnate the porous impregnation member while the liquid cosmetic material is infiltrated from an upper portion to a lower portion of the porous impregnation member, or the liquid cosmetic material is first loaded and then the impregnation member is placed thereon such that the liquid cosmetic material is infiltrated from the lower portion to the upper portion of the porous impregnation member.

4. The method according to claim 2, wherein the porous impregnation member comprises a compressive-type porous impregnation member, so that the porous impregnation member is impregnated with the liquid cosmetic material while being gradually swollen during the loading of the liquid cosmetic material.

5. A method of manufacturing capsule cosmetics, comprising:

putting a porous impregnation member into a one-piece type capsule container having on a side thereof an opening, with a filling hole formed in the porous impregnation member;

inserting a nozzle of a filling mechanism into the filling hole; and forcibly loading a liquid cosmetic material while the porous impregnation member is pressurized using a pressing plate, and simultaneously releasing a pressurizing force of the filling mechanism from the porous impregnation member, thus returning the porous impregnation member to an original state thereof from a pressed state, and thereby enabling rapid absorption and impregnation of the liquid cosmetic material.

* * * * *